US008223181B2

(12) United States Patent
Crockett et al.

(10) Patent No.: US 8,223,181 B2
(45) Date of Patent: Jul. 17, 2012

(54) WEAR-INDICATING RESISTORS FOR THERMAL PRINTHEAD

(75) Inventors: Timothy W. Crockett, Raleigh, NC (US); Stacy L. Arrington, Raleigh, NC (US)

(73) Assignee: International Business Machines Corporation, Armonk, NY (US)

( * ) Notice: Subject to any disclaimer, the term of this patent is extended or adjusted under 35 U.S.C. 154(b) by 382 days.

(21) Appl. No.: 12/647,343

(22) Filed: Dec. 24, 2009

(65) Prior Publication Data

US 2011/0157291 A1 Jun. 30, 2011

(51) Int. Cl.
*B41J 2/335* (2006.01)

(52) U.S. Cl. ..... 347/206

(58) Field of Classification Search ..... 347/206, 347/200, 204, 205, 208, 209, 198, 215, 217
See application file for complete search history.

(56) References Cited

U.S. PATENT DOCUMENTS

| | | | | |
|---|---|---|---|---|
| 1,811,765 | A | 6/1931 | Snelling | |
| 3,015,950 | A | 1/1962 | Doctor et al. | |
| 3,898,730 | A | 8/1975 | Haraway, Jr. et al. | |
| 4,947,183 | A | 8/1990 | Yagino | |
| 5,289,211 | A | 2/1994 | Morandotti et al. | |
| 5,559,286 | A | 9/1996 | White et al. | |
| 6,141,029 | A * | 10/2000 | Gunther et al. | 347/217 |
| 6,590,403 | B1 | 7/2003 | Gramer et al. | |
| 6,677,766 | B2 | 1/2004 | Mehrad et al. | |
| 6,791,591 | B2 * | 9/2004 | Conwell et al. | 347/198 |
| 6,902,107 | B2 | 6/2005 | Shay et al. | |
| 6,936,158 | B2 | 8/2005 | Nielsen et al. | |
| 7,388,386 | B2 | 6/2008 | Ramgopal et al. | |
| 2003/0122884 | A1 | 7/2003 | Cartwright | |
| 2003/0202085 | A1 | 10/2003 | Rother | |
| 2004/0017578 | A1 | 1/2004 | Gallant | |

FOREIGN PATENT DOCUMENTS

| | | | |
|---|---|---|---|
| DE | 3915996 | C1 | 6/1990 |
| DE | 102007008729 | A1 | 8/2008 |
| EP | 659567 | A1 | 6/1995 |
| JP | 402116557 | * | 5/1990 |
| JP | 2008-030238 | A | 2/2008 |

OTHER PUBLICATIONS

IPCOM000121352D (In Situ Monitoring of Heater Failure in Thermal Ink Jet Devices; IBM Technical Disclosure Bulletin, n3, Aug. 1, 1991, Eldridge et al., pp. 411-414).

* cited by examiner

*Primary Examiner* — Kristal Feggins
(74) *Attorney, Agent, or Firm* — Thomas Tyson

(57) ABSTRACT

A thermal printhead includes a substrate, a nonconductive coating over the substrate, a number of heating elements disposed on the substrate, and one or more resistors at least partially disposed within the nonconductive coating. The heating elements cause thermochromic media to selectively darken in accordance with selective activation of the heating elements as the media moves in relation to the thermal printhead, to print a desired image on the media. The nonconductive coating protects the heating elements and wears away with usage of the printhead. The media comes into contact with the nonconductive coating during printing of the desired image on the media. The resistors indicate wear of the thermal printhead, and have electrical resistances that increase as the resistors are worn away in accordance with wearing away of the nonconductive coating.

19 Claims, 5 Drawing Sheets

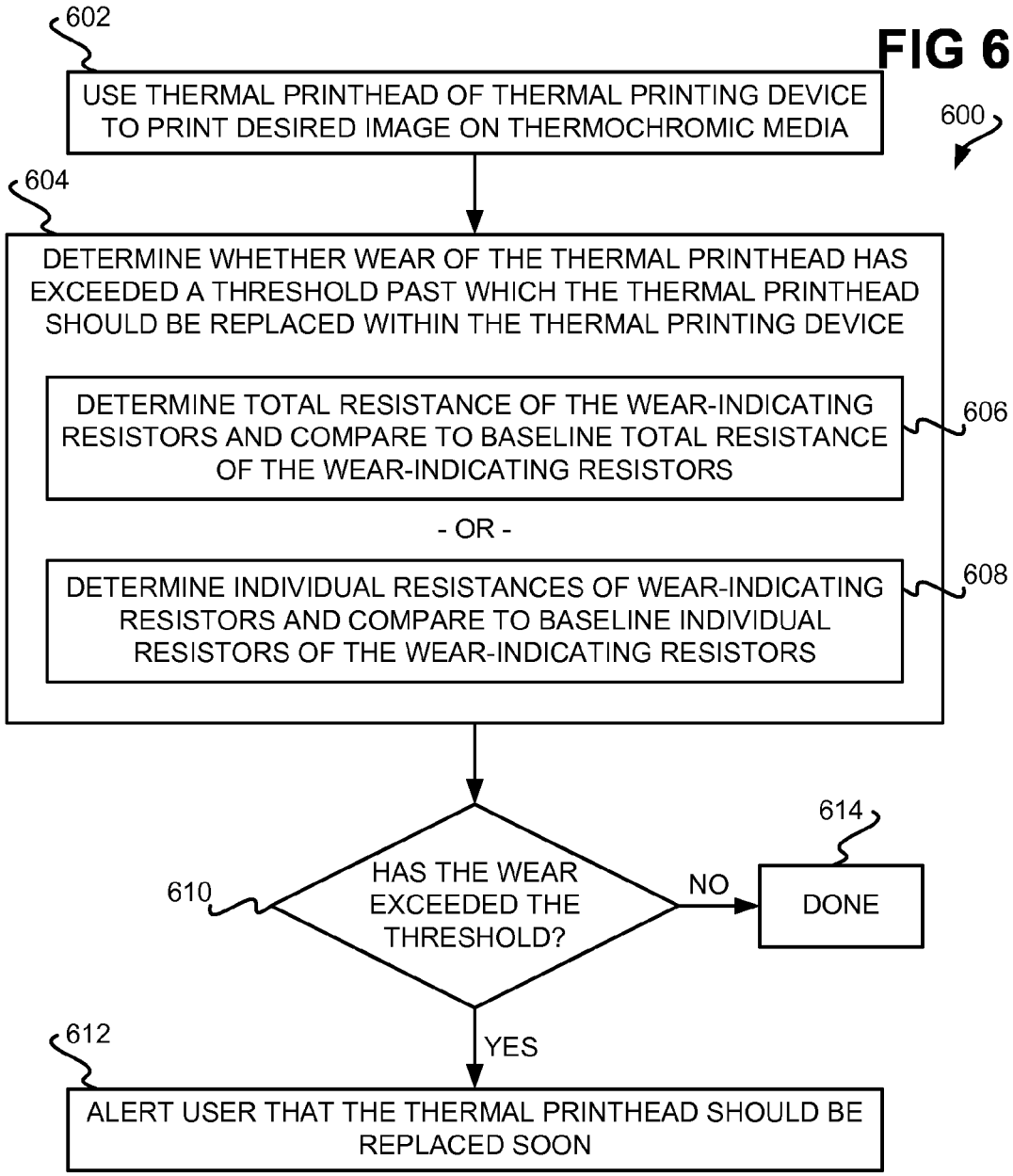
FIG 6
600
602
USE THERMAL PRINTHEAD OF THERMAL PRINTING DEVICE TO PRINT DESIRED IMAGE ON THERMOCHROMIC MEDIA
604
DETERMINE WHETHER WEAR OF THE THERMAL PRINTHEAD HAS EXCEEDED A THRESHOLD PAST WHICH THE THERMAL PRINTHEAD SHOULD BE REPLACED WITHIN THE THERMAL PRINTING DEVICE
DETERMINE TOTAL RESISTANCE OF THE WEAR-INDICATING RESISTORS AND COMPARE TO BASELINE TOTAL RESISTANCE OF THE WEAR-INDICATING RESISTORS
606
- OR -
DETERMINE INDIVIDUAL RESISTANCES OF WEAR-INDICATING RESISTORS AND COMPARE TO BASELINE INDIVIDUAL RESISTORS OF THE WEAR-INDICATING RESISTORS
608
610
HAS THE WEAR EXCEEDED THE THRESHOLD?
NO
614
DONE
YES
612
ALERT USER THAT THE THERMAL PRINTHEAD SHOULD BE REPLACED SOON

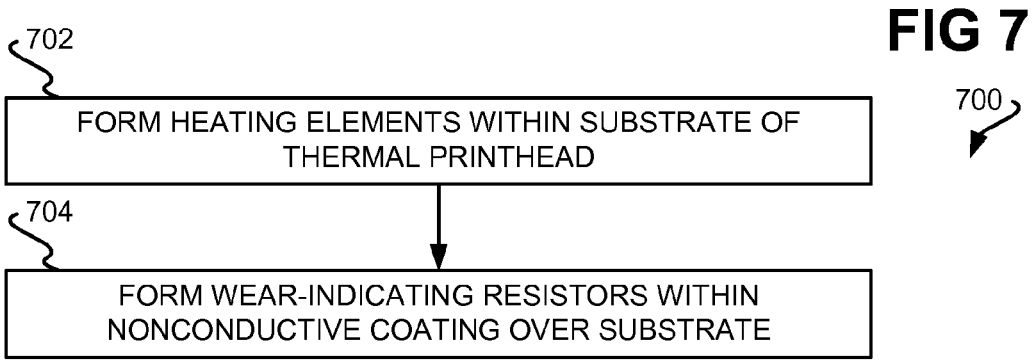
FIG 7
700
702
FORM HEATING ELEMENTS WITHIN SUBSTRATE OF THERMAL PRINTHEAD
704
FORM WEAR-INDICATING RESISTORS WITHIN NONCONDUCTIVE COATING OVER SUBSTRATE

WEAR-INDICATING RESISTORS FOR THERMAL PRINTHEAD

FIELD OF THE INVENTION

The present invention relates generally to thermal printing devices that print images on thermochromic media by selectively heating the media using heating elements. The present invention relates more particularly to including wear-indicating resistors within the thermal printheads of such thermal printing devices, so that when the printheads should be replaced within the devices can be determined.

BACKGROUND OF THE INVENTION

In retail establishments like grocery stores and department stores, receipts are given to customers when they have purchased goods as a way for the retail establishments to provide written acknowledgment that the customers have purchased the goods. The customers can then use the receipts to return the purchased goods if needed, to receive rebates on the goods, and to provide proof of when they purchased the goods should warranty repair be needed. The receipts are commonly printed as the customers are checking out of the establishments.

Indeed, in some countries, such as Italy, receipts are considered legal tax documents. If a customer cannot present a receipt showing that tax has been paid on a purchase, the customer can be fined by the government. The retail establishment itself may also be fined if it does not provide the customer with a receipt.

One typical way by which receipts can be printed relatively quickly and relatively silently is by using a thermal printing device. Unlike other types of printing devices that employ some type of colorant, such as ink or toner, to print onto media like paper, thermal printing devices do not use any type of colorant to print onto the media. Therefore, while printing devices like inkjet and laser printing devices have to have their colorant such as ink or toner periodically replenished, thermal printing devices do not.

Rather, a thermal printing device selectively heats media to print a desired image on the media as the media moves in relation to the printing device. The media darkens where it has been exposed to heat. The media used within thermal printing devices is thus a special type of media that is known as thermochromic media or more simply as thermal media, which is impregnated with a chemical that darkens when exposed to heat. While other types of printing devices may be able print on nearly any type of media, thermal printing devices thus have to use thermochromic media.

SUMMARY OF THE INVENTION

A thermal printhead of an embodiment of the invention includes a substrate, a nonconductive coating over the substrate, a number of heating elements disposed on the substrate, and one or more resistors at least partially disposed within the nonconductive coating. The heating elements cause thermochromic media to selectively darken in accordance with selective activation of the heating elements as the media moves in relation to the thermal printhead, to print a desired image on the media. The nonconductive coating protects the heating elements and wears away with usage of the printhead. The media comes into contact with the nonconductive coating during printing of the desired image on the media. The resistors indicate wear of the thermal printhead, and have electrical resistances that increase as the resistors are worn away in accordance with wearing away of the nonconductive coating.

A method of an embodiment of the invention forms a number of heating elements on a substrate of a thermal printhead. The heating elements are adapted to cause thermochromic media to selectively darken in accordance with selective activation of the heating elements as the thermochromic media moves in relation to the thermal printhead, to print a desired image on the thermochromic media. The method forms one or more resistors at least partially within a nonconductive coating over the substrate of the thermal printhead. The resistors indicate wear of the thermal printhead and have electrical resistances that increase as the resistors are worn away in accordance with wearing away of the nonconductive coating. The nonconductive coating protects the heating elements. The thermochromic media comes into contact with the nonconductive coating during printing of the desired image on the thermochromic media. The nonconductive coating wears away with usage of the thermal printhead.

A method of another embodiment of the invention uses a thermal printhead of a thermal printing device to print a desired image on thermochromic media. The thermal printhead includes a substrate, a nonconductive coating over the substrate, a number of heating elements disposed on the substrate, and one or more resistors at least partially disposed within the nonconductive coating. The heating elements cause the thermochromic media to selectively darken in accordance with selective activation of the heating elements as the media moves in relation to the thermal printhead, to print a desired image on the media. The nonconductive coating protects the heating elements and wears away with usage of the printhead. The media comes into contact with the nonconductive coating during printing of the desired image on the media. The resistors indicate wear of the thermal printhead, and have electrical resistances that increase as the resistors are worn away in accordance with wearing away of the nonconductive coating. The method determines whether the wear of the thermal printhead has exceeded a threshold past which the thermal printhead should be replaced within the thermal printing device, based on the electrical resistances of the resistors. In response to determining that the wear of the thermal printhead has exceeded the threshold, the method alerts a user that the thermal printhead should be replaced within the thermal printing device.

A thermal printing device of an embodiment of the invention includes a thermal printhead that is replaceable within the thermal printing device, a first mechanism to move thermochromic media past the thermal printhead, and a second mechanism. The thermal printhead includes a substrate, a nonconductive coating over the substrate, a number of heating elements disposed on the substrate, and one or more resistors at least partially disposed within the nonconductive coating. The heating elements cause the thermochromic media to selectively darken in accordance with selective activation of the heating elements as the media moves in relation to the thermal printhead, to print a desired image on the media. The nonconductive coating protects the heating elements and wears away with usage of the printhead. The media comes into contact with the nonconductive coating during printing of the desired image on the media. The resistors indicate wear of the thermal printhead, and have electrical resistances that increase as the resistors are worn away in accordance with wearing away of the nonconductive coating. The second mechanism determines whether the wear of the thermal printhead has exceeded a threshold past which the thermal printhead should be replaced within the thermal printing device, based on the electrical resistances of the resistors. The second mechanism further alerts the user that the thermal printhead should be replaced upon determining that the wear of the thermal printhead has exceeded the threshold.

BRIEF DESCRIPTION OF THE DRAWINGS

FIG. 6 is a flowchart of a method of use, according to an embodiment of the present invention.

FIG. 7 is a flowchart of a rudimentary method of manufacturing, according to an embodiment of the present invention.

DETAILED DESCRIPTION OF THE DRAWINGS

As noted in the background section, a thermal printing device selectively heats thermochromic media, like thermochromic paper, to print a desired image on the media as the media moves in relation to the printing device, where the thermochromic media darkens where it has been exposed to heat. The thermal printing device includes a thermal printhead that has a number of heating elements. The heating elements are selectively activated in accordance with the desired image to print the desired image on the media.

During printing, the thermal printhead typically comes into contact with the thermochromic media to transfer heat from the heating elements to the media. However, prolonged usage of the thermal printing device can result in a portion of the thermal printhead wearing away, such that the heating elements within the printhead become exposed. Exposure of the heating elements can result in their failure. As such, the heating elements are no longer able to increase in temperature sufficiently to correspondingly darken the thermochromic media.

That the heating elements within the thermal printhead are beginning to be exposed cannot usually be detected until the heating elements have failed. This means that a number of images will be printed on thermochromic media in a less-than-optimal manner, until the thermal printhead can be replaced with a new one. For instance, a thermal printhead having failed heating elements can result in the presence of white bands within the images printed on thermochromic media. This is because the heating elements cannot sufficiently heat the thermochromic media to cause the media to darken, resulting in undarkened locations on the media where the media was supposed to have been darkened in accordance with the image.

Embodiments of the invention permit the wearing away of thermal printheads to be detected, ideally before the heating elements themselves have failed. Therefore, the thermal printheads can be replaced before they result in suboptimal printing of images on thermochromic media. In particular, embodiments of the invention embed one or more wear-detecting resistors within a thermal printhead. As the thermal printhead wears away, so do the wear-detecting resistors, causing their electrical resistances to change. When these electrical resistances have changed by more than a threshold, a user can be alerted that the heating elements of the thermal printhead are likely to fail soon—but prior to failure—and that the printhead should be replaced soon so that the quality of the printed images does not degrade.

Figure 1A:
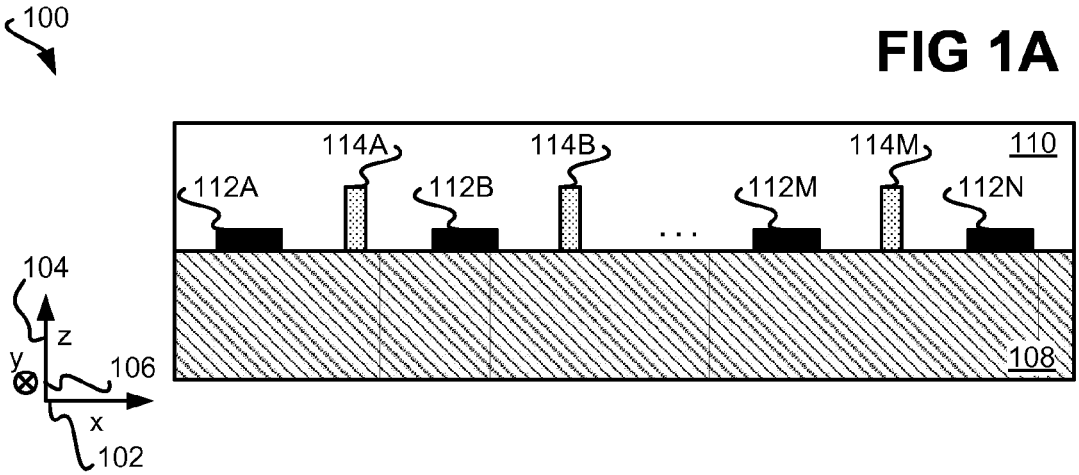
FIGS. 1A, 1B, and 1C are diagrams of a front view, a top view, and a side view, respectively, of a thermal printhead for a thermal printing device, according to an embodiment of the present invention.
Figure 1B:
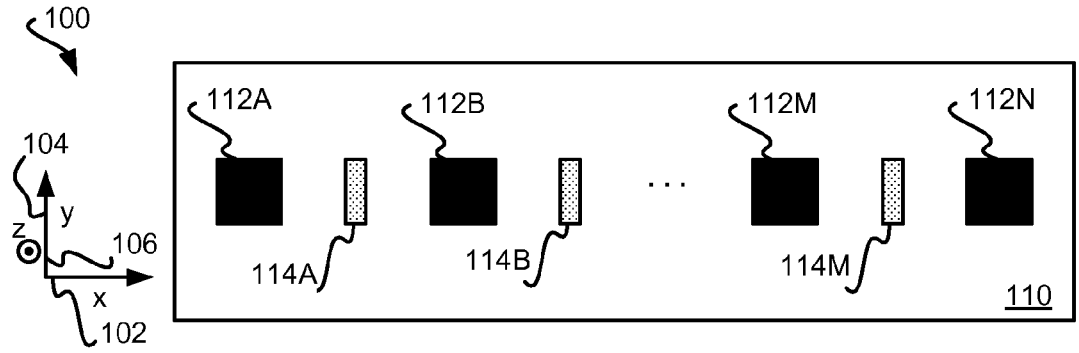
Figure 1C:
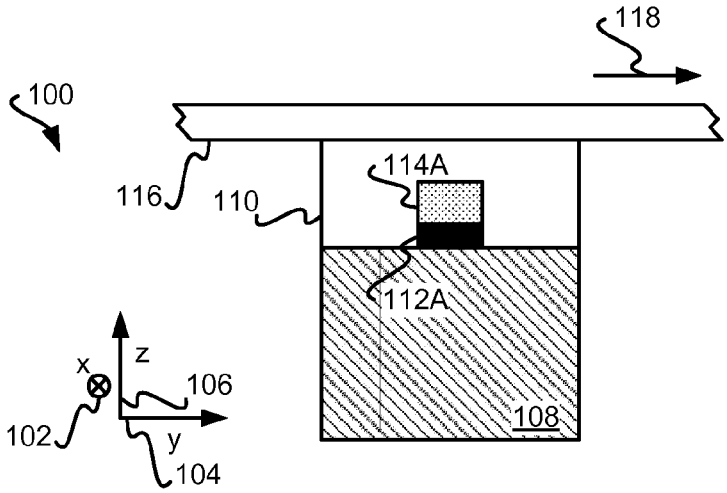

FIGS. 1A, 1B, and 1C show a front view, a top view, and a side view, respectively, of a thermal printhead 100 for a thermal printing device, according to an embodiment of the invention. An x-axis 102, a y-axis 104, and a z-axis 106 are depicted in FIGS. 1A, 1B, and 1C to denote the spatial relationships among these figures. The thermal printhead 100 includes a substrate 108, which may be a ceramic substrate in one embodiment, and a nonconductive coating 110 over the substrate 108. The nonconductive coating 110 may be a ceramic glass coating in one embodiment.

Heating elements 112A, 112B, . . . , 112M, and 112N, collectively referred to as the heating elements 112, are formed on the substrate 108. The heating elements 112 are selectively activated to correspondingly selectively darken thermochromic media 116 as the media 116 moves in relation to the thermal printhead 100, as indicated by the arrow 118 in FIG. 1C, to print a desired image on the media 116. When a given location of the thermochromic media 116 is over a given heating element 112 when the heating element 112 has been activated, the media 116 is darkened at this location.

The nonconductive coating 110 is nonconductive in that the coating 110 is electrically nonconductive, but the coating 110 is desirably thermally conductive. The thermochromic media 116 comes into contact with the nonconductive coating 110 during printing of a desired image on the media 116, to maximize transfer of heat from the heating elements 112 to the media 116. The heating elements 116 may be resistive heating elements in one embodiment. The nonconductive coating 110 protects the heating elements 112 from directly coming into contact with the media 116.

Wear-indicating resistors 114A, 114B, . . . , 114M, collectively referred to as the wear-indicating resistors 114, are at least partially embedded within the nonconductive coating 110. The coating 110 is thus electrically nonconductive at least so that the resistors 114 are not electrically shorted by the coating 110. As depicted in FIGS. 1A and 1C, the wear-indicating resistors 114 are completely embedded within the nonconductive coating 110. However, in another embodiment, portions of the wear-indicating resistors 114 may alternatively be embedded within the substrate 108 as well. In this embodiment, though, other portions of the wear-indicating resistors 114 are still embedded within the nonconductive coating 110.

The wear-indicating resistors 114 are depicted in FIGS. 1A, 1B, and 1C as being positionally interleaved among the heating elements 112, such that between each pair of heating elements 112 there is a resistor 114. More generally, there is at least one wear-indicating resistor 114. The wear-indicating resistors 114 may be interleaved among the heating elements 112 such that there is one resistor 114 for every two, three, four, or more heating elements 112, up to the total number N of the heating elements 112. The heating elements 112 themselves are organized in a one-by-N array at a predetermined dots-per-inch spacing.

In general, as the thermal printhead 100 is used, the nonconductive coating 110 regularly or irregularly wears away. This is because the thermochromic media 116 comes into contact with the nonconductive coating 110, presenting a wearing frictional force that causes the coating 110 to wear away. Furthermore, contaminants such as grit may become lodged between the thermochromic media 116 and the nonconductive coating 110, causing the coating 110 to wear down even more quickly.

At some point, the nonconductive coating 110 will have sufficiently worn away to expose one or more of the heating elements 112, which can result in failure of the exposed heating elements 112. The wear-indicating resistors 114 indicate wear of the thermal printhead 100 prior to the heating elements 112 becoming exposed, because the resistors 114 wear away in accordance with the wearing away of the nonconductive coating 110 itself. In this respect, the wear-indicating resistors 114 may be formed from a material having a hardness that is substantially the same as the hardness of the coating 110.

For example, the wear-indicating resistors 114 may be formed from carbon or metal film. As such, the wear-indicating resistors 114 when exposed to the same wearing force as the nonconductive coating 110 can wear down at substantially the same rate as the coating 110 does. As the wear-indicating resistors 114 wear down, their electrical resistances increase. By measuring the electrical resistances of the resistors 114, therefore, it can be determined that the thermal printhead 100 has worn down sufficiently to warrant replacement, before the heating elements 112 become exposed and fail. In this respect, the height of the wear-indicating resistors 114 along the z-axis 106 is greater than (i.e., taller than) the height of the heating elements 112, so that the resistors 112 are exposed and wear away before the heating elements 112 are exposed.

Figure 2:
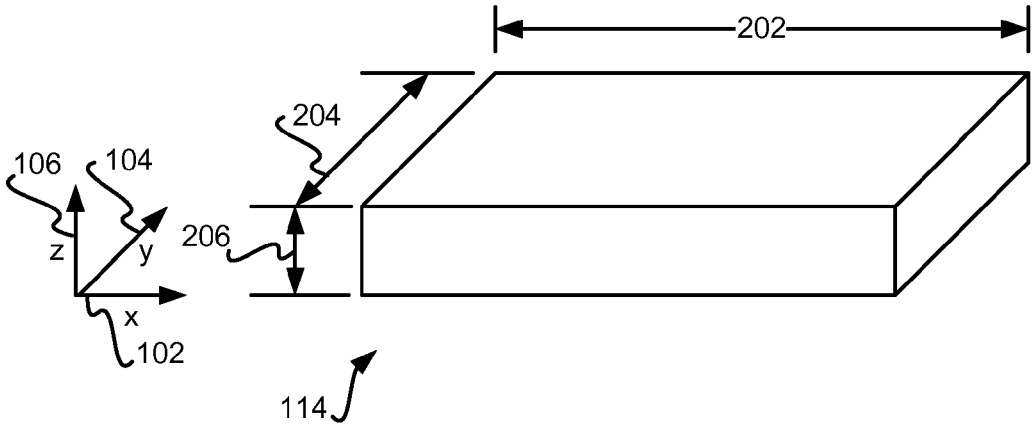
FIG. 2 is a diagram of a perspective view of a representative wear-indicating resistor, according to an embodiment of the present invention.

FIG. 2 shows a perspective view of a representative wear-indicating resistor 114, according to an embodiment of the invention. The x-axis 102, y-axis 104, and z-axis 106 are depicted in FIG. 2 to show the spatial relationship of the wear-indicating resistor 114. The wear-indicating resistor 114 has a length 202 along the x-axis 102, a width 204 along the y-axis 104, and a height 206 along the z-axis 106. The x-axis 102 and the y-axis 104 define a plane, which is the plane of the nonconductive coating 110, as can be seen in FIG. 1B. The length 202 and the width 204 are thus along this plane, whereas the height 206 is perpendicular to this plane, because the z-axis 106 is perpendicular to the x-axis 102 and the y-axis 104.

The electrical resistance of the wear-indicating resistor 114 of FIG. 2 is defined as $$R = k\frac{L}{WH},$$

where R is the electrical resistance of the resistor 114, L is the length 202, W is the width 204, and H is the height 206. Furthermore, k is a resistive constant of the material from which the resistor 114 is formed. Therefore, the electrical resistance of the resistor 114 is equal to the product of the constant k and the length L, divided by the product of the width W and the height H.

As the wear-indicating resistor 114 wears away in accordance with the nonconductive coating 110 of the thermal printhead 100 of FIGS. 1A, 1B, and 1C wearing away, the height 206 of the resistor 114 in particular decreases. Furthermore, because the electrical resistance of the resistor 114 is inversely proportional to its height 206, the electrical resistance of the resistor 114 increases as the thermal printhead 100 wears away. Therefore, the wearing away of the thermal printhead 100 can be detected by monitoring the electrical resistances of all the resistors 114, before the nonconductive coating 110 has sufficiently worn away to expose the heating elements 112.

Figure 3:
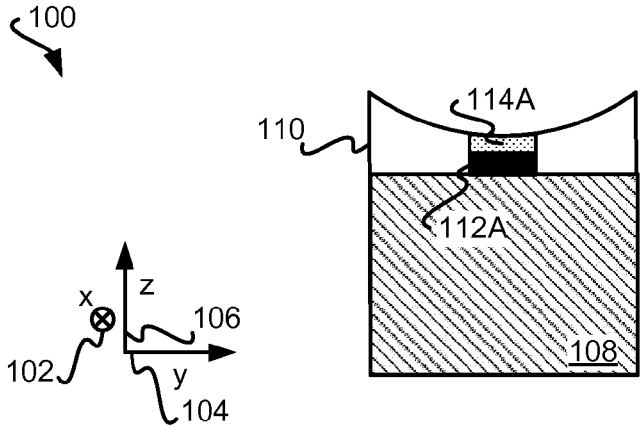
FIG. 3 is a diagram of a front view of a portion of the thermal printhead 100 that has worn away, according to an embodiment of the present invention.

FIG. 3 depicts the front view of the wearing away of a portion of the thermal printhead 100, according to an embodiment of the invention. The x-axis 102, the y-axis 104, and the z-axis 106 are depicted in FIG. 3 to show the spatial relationship of the thermal printhead 100. Between the heating elements 112, the nonconductive coating 110 has worn away. A portion of the wear-indicating resistor 114 has correspondingly worn away, specifically its height, which can be seen by comparing the resistor 114 in FIG. 3 to the resistors 114 in FIG. 1A.

The electrical resistance of the resistor 114 has thus decreased in FIG. 3 and compared to as in FIG. 1A. However, neither of the heating elements 112 has yet to be exposed in FIG. 3. That is, the nonconductive coating 110 has not sufficiently worn away to expose the heating elements 112 in FIG. 3. Therefore, by monitoring the electrical resistance of the resistor 114 in FIG. 3, that the thermal printhead 100 has worn away can be detected before the nonconductive coating 110 has sufficiently worn away to expose the heating elements 112. As such, the printhead 100 can be replaced before image quality is degraded.

Figure 4A:
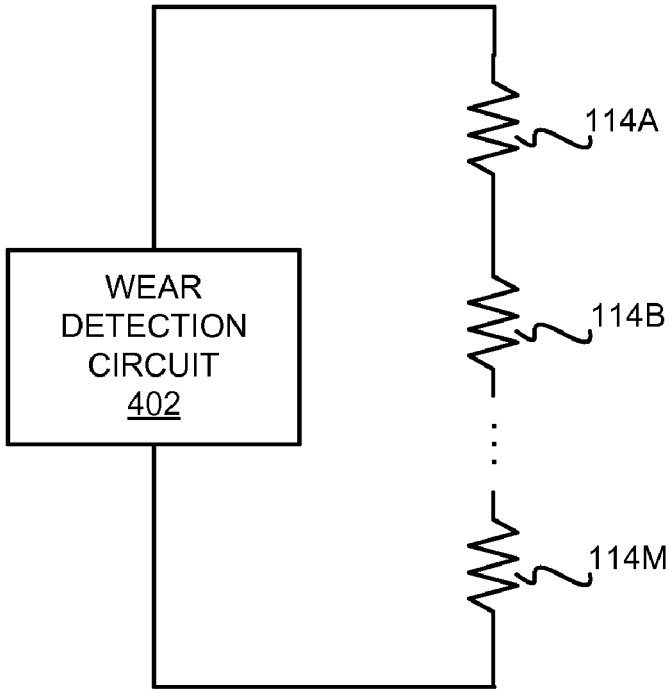
FIGS. 4A and 4B are electrical schematics of how wear-indicator resistors can be arranged, according to different embodiments of the present invention.
Figure 4B:
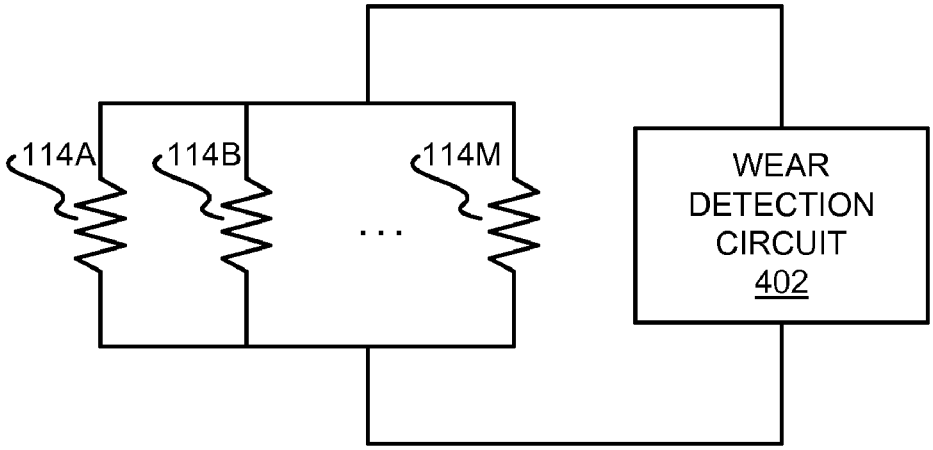

FIGS. 4A and 4B show how the wear-indicating resistors 114 can be arranged in either series or parallel, according to different embodiments of the invention. In FIG. 4A, the resistors 114 are connected in series with one another, whereas in FIG. 4B, the resistors 114 are connected in parallel with one another. A suitable wear detection circuit 402 is connected to the wear-indicating resistors 114, as indicated in FIGS. 4A and 4B, to measure the resistance of the resistors 114. In FIGS. 4A and 4B, the wear detection circuit 402 measures the total resistance of the resistors 114, but in another embodiment, the circuit 402 may measure the individual resistances of the resistors 114. The wear detection circuit 402 may be embedded within the nonconductive coating 110 of FIGS. 1A, 1B, and 1C.

In FIG. 4A, the total electrical resistance R of the wear-indicating resistors 114 is equal to $$\sum_{j=1}^{m} R_j,$$

where there are m resistors 114 and $R_j$ is the electrical resistance of the j-th resistor. By comparison, in FIG. 4B, the total electrical resistance R of the wear-indicating resistors 114 is equal to $$\frac{1}{\sum_{j=1}^{m} \frac{1}{R_j}}.$$

Therefore, in both FIGS. 4A and 4B, when one or more of the wear-indicating resistors 114 wear down, reducing the corresponding resistance $R_j$ of each of these resistors 114, the total electrical resistance R of all the resistors 114 decreases as well.

Figure 5:
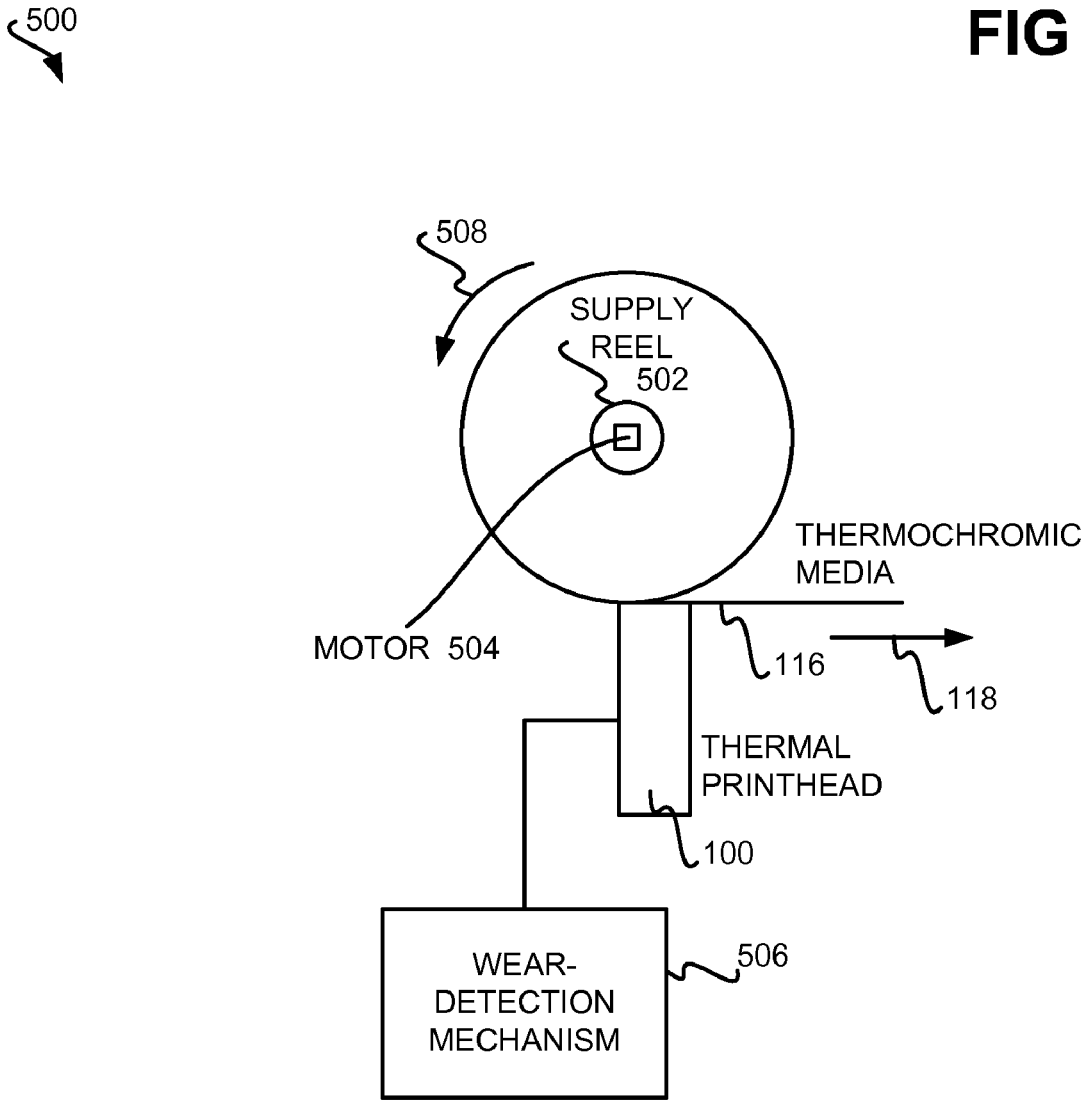
FIG. 5 is a diagram of a representing thermal printing device, according to an embodiment of the present invention.

FIG. 5 shows a representative thermal printing device 500, according to an embodiment of the invention. The thermal printing device includes the thermal printhead 100 that has been described, as well as a supply reel 502, a motor 504, and a wear-detection mechanism 506. The thermochromic media 116 is supplied in the form of a roll wrapped around the supply reel 502. The motor 504 rotates in a counter-clockwise direction, causing the supply reel 502 to correspondingly rotate to unroll the thermochromic media 116, as indicated by the arrow 508, past the thermal printhead 100, as indicated by the arrow 118. As the thermochromic media 116 moves past the thermal printhead 100, the heating elements 112 of the printhead 100 (not depicted in FIG. 5) are selectively activated to selectively darken the media 116 to print a desired image on the media 116. The printhead 100 remains stationary while the desired image is printed on the media 116, but is replaceable.

The supply reel 502 is more generally a mechanism that is adapted to receive the roll of the thermochromic media 116. The motor 504 is more generally a mechanism that moves the thermochromic media 116 past the thermal printhead 100, and that in the embodiment of FIG. 5 is adapted to unroll the media 116 from the roll of the media 116 on the supply reel 502. The thermal printing device 500 is particularly suitable to be a receipt printing device located in retail establishments like grocery stores and department stores. In other embodiments, however, the thermal printing device 500 may be a printing device that is used by businesspeople and consumers to print desired images, such as text and/or graphics. The thermal printing device 500 may use flat sheets of thermochromic media 116, instead of a roll of the media 116 as in FIG. 5.

The wear-detection mechanism 506 is to detect the wear of the thermal printhead 100. The mechanism 506 may be implemented in software, hardware, or a combination of software and hardware. For example, the mechanism 506 may be hardware where it is an applications-specific integrated circuit (ASIC). As another example, the mechanism 506 may be software that is stored on a tangible computer-readable data storage medium, such as a dynamic random-access memory or a read-only memory, and that is executed by a processor. The mechanism 506 can include the wear detection circuit 402 of FIG. 4 in one embodiment.

The mechanism 506 more specifically determines whether this wear has exceeded a predetermined threshold, past which the thermal printhead 100 should be replaced within the printing device 500. The mechanism 506 makes this determination based on the electrical resistances of the wear-indicating resistors 114 (not depicted in FIG. 5). If the wear has exceeded a predetermined threshold, then the mechanism 506 alerts a user that the thermal printhead 100 should be replaced soon. For instance, the wear-detection mechanism 506 may determine whether the current total electrical resistance of the wear-indicating resistors 114 has increased by more than a predetermined amount in relation to a baseline total electrical resistance of the resistors 114 when the thermal printhead was new and first inserted in the printing device 500.

FIG. 6 shows a method 600 of use, according to an embodiment of the invention. The thermal printhead 100 of the thermal printing device 500 is used to print a desired image on the thermochromic paper 118 (602), as has been described. Periodically, it is determined whether the wear of the thermal printhead 100 has exceeded a threshold past which the printhead 100 should be replaced within the thermal printing device (604).

In one embodiment, this is achieved as follows. The current total resistance of the resistors 114 is determined and compared to a baseline total resistance of the resistors 114 when the thermal printhead 100 was first inserted into the thermal printing device 500 (606). If the current total resistance exceeds the baseline total resistance by more than a predetermined amount—either as a percentage or in absolute terms—then it is said that the wear of the thermal printhead 100 has exceeded the threshold past which the printhead 100 should be replaced soon.

Alternatively, the individual resistance of each resistor 114 may be determined and compared to a corresponding baseline resistance of each resistor 114 when the thermal printhead 100 was first inserted into the thermal printing device 500 (608). If the individual resistances of more than a predetermined number of the resistors 114 have exceeded their baseline resistances by more than a predetermined amount, then it is said that the wear of the thermal printhead 100 has exceeded the threshold past which the printhead should be replaced soon.

Therefore, if the wear has exceeded this threshold (610), the user is alerted that the thermal printhead should be replaced soon (612). Otherwise, the method 600 is finished without the user being alerted.

In conclusion, FIG. 7 shows a rudimentary method 700 of manufacture, according to an embodiment of the invention. The heating elements 112 are formed on the substrate 108 of the thermal printhead 100 (702). The wear-indicating resistors 114 are formed within the nonconductive coating 110 of the printhead 100 (704). For example, the wear-indicating resistors 114 may be formed on top of the substrate 108 after the heating elements 112 have been formed on top of the substrate 108. Thereafter, the nonconductive coating 110 may be applied over the substrate 108, such that the coating 110 covers the wear-indicating resistors 114 as well as the heating elements 112 embedded within the substrate 108.

It is finally noted that, although specific embodiments have been illustrated and described herein, it will be appreciated by those of ordinary skill in the art that any arrangement that is calculated to achieve the same purpose may be substituted for the specific embodiments shown. Other applications and uses of embodiments of the invention, besides those described herein, are amenable to at least some embodiments. This application is intended to cover any adaptations or variations of the present invention. Therefore, it is manifestly intended that this invention be limited only by the claims and equivalents thereof.

We claim:

1. A thermal printhead comprising:

a substrate;

a plurality of heating elements disposed on the substrate, the heating elements adapted to cause thermochromic media to selectively darken in accordance with selective activation of the heating elements as the thermochromic media moves in relation to the thermal printhead, to print a desired image on the thermochromic media;

a nonconductive coating over the substrate to protect the heating elements and with which the thermochromic media comes into contact during printing of the desired image on the thermochromic media, the nonconductive coating to wear away with usage of the thermal printhead; and, one or more resistors at least partially disposed within the nonconductive coating to indicate wear of the thermal printhead, the resistors having electrical resistances that increase as the resistors are worn away in accordance with wearing away of the nonconductive coating.

2. The thermal printhead of claim 1, wherein the electrical resistance of each resistor is equal to a product of a constant and a length of the resistor divided by a product of a width of a resistor and a height of the resistor, where the length and the width is in a plane of the nonconductive coating, and the height of the resistor is perpendicular to the plane of the nonconductive coating, such that wearing away of the resistors in accordance with the wearing away of the nonconductive coating results in a decrease in the heights of the resistors, increasing the electrical resistances of the resistors.

3. The thermal printhead of claim 1, wherein the heating elements are organized in a one-by-n array having a predetermined dots-per-inch spacing, where n is equal to a number of the heating elements, and the resistors are positionally interleaved in relation to the heating elements.

4. The thermal printhead of claim 3, wherein the resistors are positionally interleaved in relation to the heating elements such that there is one of the resistors for every x of the heating elements, where x is equal to a number between one and the number of the heating elements.

5. The thermal printhead of claim 1, wherein the resistors are electrically connected to one another in series, such that a total electrical resistance of the resistors is equal to $$\sum_{j=1}^{m} R_j,$$

where m is equal to a number of the resistors, and $R_j$ is an electrical resistance of the j-th resistor, and such that the total electrical resistance of the resistors increases as the resistors wear away in accordance with the wearing away of the nonconductive coating.

6. The thermal printhead of claim 1, wherein the resistors are electrically connected to one another in parallel, such that a total electrical resistance of the resistors is equal to $$\frac{1}{\sum_{j=1}^{m} \frac{1}{R_j}},$$

where m is equal to a number of the resistors, and $R_j$ is an electrical resistance of the j-th resistor, and such that the total electrical resistance of the resistors increases as the resistors wear away in accordance with the wearing away of the nonconductive coating.

7. The thermal printhead of claim 1, wherein the substrate is a ceramic substrate, and wherein the nonconductive coating is a ceramic glass coating.

8. The thermal printhead of claim 1, wherein the resistors are formed from one of carbon and metal film.

9. A method comprising:

forming a plurality of heating elements on a substrate of a thermal printhead, the heating elements adapted to cause thermochromic media to selectively darken in accordance with selective activation of the heating elements as the thermochromic media moves in relation to the thermal printhead, to print a desired image on the thermochromic media; and, forming one or more resistors at least partially within a nonconductive coating over the substrate of the thermal printhead, the resistors to indicate wear of the thermal printhead and having electrical resistances that increase as the resistors are worn away in accordance with wearing away of the nonconductive coating, wherein the nonconductive coating is to protect the heating elements, the thermochromic media to come into contact with the nonconductive coating during printing of the desired image on the thermochromic media, the nonconductive coating to wear away with usage of the thermal printhead.

10. The method of claim 9, wherein the electrical resistance of each resistor is equal to a product of a constant and a length of the resistor divided by a product of a width of a resistor and a height of the resistor, where the length and the width is in a plane of the nonconductive coating, and the height of the resistor is perpendicular to the plane of the nonconductive coating, such that wearing away of the resistors in accordance with the wearing away of the nonconductive coating results in a decrease in the heights of the resistors, increasing the electrical resistances of the resistors.

11. The method of claim 9, wherein the heating elements are organized in a one-by-n array having a predetermined dots-per-inch spacing, where n is equal to a number of the heating elements, and the resistors are positionally interleaved in relation to the heating elements such that there is one of the resistors for every x of the heating elements, where x is equal to a number between one and the number of the heating elements.

12. A method comprising:

using a thermal printhead of a thermal printing device to print a desired image on thermochromic media, the thermal printhead comprising:

a substrate;

a plurality of heating elements disposed on the substrate, the heating elements adapted to cause the thermochromic media to selectively darken in accordance with selective activation of the heating elements as the thermochromic media moves in relation to the thermal printhead, to print the desired image on the thermochromic media;

a nonconductive coating over the substrate to protect the heating elements and with which the thermochromic media comes into contact during printing of the desired image on the thermochromic media, the nonconductive coating to wear away with usage of the thermal printhead; and, one or more resistors at least partially disposed within the nonconductive coating to indicate wear of the thermal printhead, the resistors having electrical resistances that increase as the resistors are worn away in accordance with wearing away of the nonconductive coating;

determining whether the wear of the thermal printhead has exceeded a threshold past which the thermal printhead should be replaced within the thermal printing device, based on the electrical resistances of the resistors; and, in response to determining that the wear of the thermal printhead has exceeded the threshold, alerting a user that the thermal printhead should be replaced within the thermal printing device.

13. The method of claim 12, wherein the electrical resistance of each resistor is equal to a product of a constant and a length of the resistor divided by a product of a width of a resistor and a height of the resistor, where the length and the width is in a plane of the nonconductive coating, and the height of the resistor is perpendicular to the plane of the nonconductive coating, such that wearing away of the resistors in accordance with the wearing away of the nonconductive coating results in a decrease in the heights of the resistors, increasing the electrical resistances of the resistors.

14. The method of claim 12, wherein determining whether the wear of the thermal printhead has exceeded the threshold past which the thermal printhead should be replaced within the thermal printing device comprises:

determining whether a current total electrical resistance of the resistors has increased in relation to a baseline total electrical resistance of the resistors when the thermal printhead was new, by more than a predetermined amount.

15. The method of claim 12, wherein determining whether the wear of the thermal printhead has exceeded the threshold past which the thermal printhead should be replaced within the thermal printing device comprises:

determining whether individual electrical resistances of more than a predetermined number of resistors have increased in relation to baseline individual electrical resistances of the resistors when the thermal printhead was new, by more than a predetermined amount.

16. A thermal printing device comprising:

a thermal printhead that is replaceable within the thermal printing device;

a first mechanism to move thermochromic media past the thermal printhead, the thermal printhead comprising:

a substrate;

a plurality of heating elements disposed within the substrate, the heating elements adapted to cause the thermochromic media to selectively darken in accordance with selective activation of the heating elements as the thermochromic media moves in relation to the thermal printhead, to print a desired image on the thermochromic media;

a nonconductive coating over the substrate to protect the heating elements and with which the thermochromic media comes into contact during printing of the desired image on the thermochromic media, the nonconductive coating to wear away with usage of the thermal printhead;

one or more resistors at least partially disposed within the nonconductive coating to indicate wear of the thermal printhead, the resistors having electrical resistances that increase as the resistors are worn away in accordance with wearing away of the nonconductive coating; and, a second mechanism to determine whether the wear of the thermal printhead has exceeded a threshold past which the thermal printhead should be replaced within the thermal printing device, based on the electrical resistances of the resistors, and to alert the user that the thermal printhead should be replaced upon determining that the wear of the thermal printhead has exceeded the threshold.

17. The thermal printing device of claim 16, wherein the electrical resistance of each resistor is equal to a product of a constant and a length of the resistor divided by a product of a width of a resistor and a height of the resistor, where the length and the width is in a plane of the nonconductive coating, and the height of the resistor is perpendicular to the plane of the nonconductive coating, such that wearing away of the resistors in accordance with the wearing away of the nonconductive coating results in a decrease in the heights of the resistors, increasing the electrical resistances of the resistors.

18. The thermal printing device of claim 16, wherein the heating elements are organized in a one-by-n array having a predetermined dots-per-inch spacing, where n is equal to a number of the heating elements, and the resistors are positionally interleaved in relation to the heating elements such that there is one of the resistors for every x of the heating elements, where x is equal to a number between one and the number of the heating elements.

19. The thermal printing device of claim 16, further comprising a third mechanism to receive a roll of the thermochromic media, wherein the first mechanism is adapted to unroll the thermochromic media from the roll and past the thermal printhead while the heating elements of the thermal printhead are selectively activated, to print the desired image on the thermochromic media, and wherein the thermal printhead remains stationary while the desired image is printed on the thermochromic media.

* * * * *